United States Patent [19]

Goldbach et al.

[11] Patent Number: 4,843,981

[45] Date of Patent: Jul. 4, 1989

[54] FINES RECIRCULATING FLUID BED COMBUSTOR METHOD AND APPARATUS

[75] Inventors: Gary O. Goldbach, San Jose; Jerry L. Cooper, Mountain View, both of Calif.; John L. Guillory, Lafayette, La.

[73] Assignee: Combustion Power Company, Menlo Park, Calif.

[21] Appl. No.: 134,959

[22] Filed: Dec. 18, 1987

Related U.S. Application Data

[63] Continuation-in-part of Ser. No. 864,620, May 16, 1986, abandoned, which is a continuation of Ser. No. 654,302, Sep. 24, 1986, abandoned.

[51] Int. Cl.[4] ..... F23D 1/00

[52] U.S. Cl. ..... 110/347; 110/245; 110/263; 110/345; 122/4 D

[58] Field of Search ..... 110/245, 263, 345, 346, 110/347; 122/4 D; 431/7, 170

[56] References Cited

U.S. PATENT DOCUMENTS

| | | | |
|---|---|---|---|
| 3,645,237 | 2/1972 | Seth | 122/4 D |
| 3,805,713 | 4/1974 | Notary et al. | 110/245 |
| 4,021,184 | 5/1977 | Priestley | 110/245 X |
| 4,103,646 | 8/1978 | Yerushalmi et al. | 122/4 D |
| 4,111,158 | 9/1978 | Reh et al. | 110/243 X |
| 4,325,327 | 4/1982 | Kantesaria et al. | 110/245 X |
| 4,335,084 | 6/1982 | Brogan | 110/345 X |
| 4,359,326 | 11/1982 | Hoffert et al. | 110/245 X |
| 4,476,790 | 10/1984 | Borio et al. | 122/4 D X |
| 4,506,608 | 3/1985 | Strohmeyer, Jr. | 110/345 |

FOREIGN PATENT DOCUMENTS

| | | |
|---|---|---|
| 143643 | 12/1980 | Norway . |
| 145632 | 1/1982 | Norway . |
| 153746 | 2/1986 | Norway . |

*Primary Examiner*—Steven E. Warner

*Attorney, Agent, or Firm*—Flehr, Hohbach, Test, Albritton & Herbert

[57] ABSTRACT

A fluidized bed combustor for burning solid fuel or dirty liquid fuels comprised of a bubbling fluid bed with tubes in the bed, an isothermal, non-heat extractive freeboard/recycle cyclone flow path, a hot recycle cyclone, a connective heat exchanger and a particle filter. The bubbling fluid bed is operated at low superficial velocities of 0.5 to 7 ft/sec and is composed of fine particulates 45 to 2000 microns in diameter with up to 40% less than 200 microns. Fines elutriated from the bed are isothermally recycled back to the bed resulting in high combustion efficiency and good sulfur oxide suppression from sorbents contained in the bed. The material recycled in one hour is equivalent to twice the weight of the bed. Ammonia injected upstream of the recycle cyclone suppresses nitrogen oxides with high efficiency because of the excellent mixing in the cyclone. The heat transfer coefficient on the tubes in the bed is increased at least 2 to 4 times because of the fine particulate in the bed. Fluidization occurs over a 10:1 range in superficial velocities. The present invention relates in general to fluid bed combustors and more particularly to a bubbling fluid bed with a high combustion efficiency, good sorbent utilization, non-heat extraction in the combustor freeboard above the bed and no secondary air introduction in the area above the bed to complete the oxidation reactions.

41 Claims, 2 Drawing Sheets

FINES RECIRCULATING FLUID BED COMBUSTOR METHOD AND APPARATUS

RELATED APPLICATIONS

This application is a continuation-in-part of pending U.S. patent application Ser. No. 864,620, filed May 16, 1986, now abandoned which, in turn is a continuation of U.S. patent application Ser. No. 654,302, filed Sept. 24, 1984 (now abandoned).

BACKGROUND OF THE INVENTION

Fluid bed boilers burning high sulfur coal are well known in the art. These boilers use classical bubbling bed technology whereby the fluid bed operates with superficial velocities in the range of 4 to 12 ft/sec and the bed is composed of particles with an average diameter of approximately 1000 microns. Coal is burned in the bubbling bed and limestone or dolomite sorbent is added to suppress the sulfur oxide emissions. The sorbent is added in particle sizes of 1000 to 3000 microns and the bed is composed largely of coal ash, spent sorbent, partially spent sorbent and partially burned fuel particles. The bubbling bed contains tubes within it to transfer heat to the steam. Tubes are also mounted above the bed in the freeboard to transfer heat from the hot combustion gases, thus cooling them. In operation, the bed elutriates fine particulates comprised of char, ash and partially spent sorbent. Many of these particles are captured by a recycle cyclone located downstream of the convective heat exchanger and these particles are returned to the bed in order to burn the fuel particles and allow unused sorbent to absorb more sulfur oxides. Very fine particles escape the recycle cyclone and are trapped in a filter system. The flow rate in the recycle loop is approximately equal to the total solids flow rate of the fuel and the sorbent fed into the combustor.

Conventional fluid bed boilers have several disadvantages. One disadvantage is that the combustion efficiency is low, approximately 97%, because small particles of unburned fuel escape to the combustion system. This problem would be vastly exacerbated if the boiler were to attempt to burn a low volatile content fuel such as petroleum coke which has 90% fixed carbon compared to 42% fixed carbon for coal. The second disadvantage is low sorbent utilization. A calcium to sulfur molar ratio of at least 3:1 must be maintained to produce sulfur oxide suppression of 90% to meet typical air pollution requirements. The reason for this is that the relatively large particles of sorbent only absorb sulfur oxides on their surface, leaving their interior material largely unused. A third disadvantage is that these boilers emit nitrogen oxides as a pollutant; the nitrogen oxides are generated from fuel-bound nitrogen. In many parts of the country the nitrogen oxide emissions do not exceed local limits but in some areas, such as California, they do. Moreover, a significant amount of combustion occurs in the freeboard volume above the fluidized bed. This results in fuel combustion in a zone where solids are in a very lean concentration and where there is only a very insignificant concentration of sorbent available to react with the sulfur oxide generated in that zone, as compared to the sorbent concentration within the bubbling bed itself. In addition, the continued heat extraction and associated cooling of gases in the freeboard zone do not provide the temperature conditions and residency time necessary to efficiently drive the reactions for sulfur oxide and nitrogen oxide suppression.

To improve combustion efficiency of conventional fluid bed boilers, Stewart et al. in U.S. Pat. No. 4,177,741 teaches the agglomeration of the recycled fines before reintroducing them into the bubbling bed. The agglomerated fines are thus prevented from being blown out of the bed and are thus encouraged to burn in the bed. Jones, U.S. Pat. No. 4,259,911 teaches agglomeration of coal fines plus recycled material before injection into the bed. To improve the utilization of sorbent, Jones U.S. Pat. No. 4,329,234 teaches the removal of a portion of the fluid bed and grinding the sorbent particles to 50 microns in diameter to fracture them, exposing new surface for additional sorption of sulfur oxides. The fractured particles are reintroduced into the bed by being agglomerated with the coal (fuel). All of these approaches are simple modifications of the classic bubbling bed boiler described earlier.

Reh et al. in German Pat. No. DE 3,023,480 describes a different approach to obtain good sorbent utilization in suppressing sulfur oxides from combustion gases. Reh et al. passes combustion gas through a fluidized bed of sorbent with particle size of 30 to 200 microns and a superficial velocity of 3 to 30 ft/second, producing an entrained bed with a particle density of 0.1 to 10 kg/cu m. The particulate entrained by the high gas velocity is removed by a recycle cyclone and returned to the bed, which is between 1300° F. and 2000° F. in temperature. The hourly recycle rate is approximately five times the bed weight. This approach achieves good sulfur oxide suppression by the use of fine particulate with large surface area and vigorous mixing. Reh however, does not teach combustion in the entrained bed of heat recovery with tubes from the entrained bed.

Reh in U.S. Pat. No. 4,111,158 described a fluid bed combustor based upon the principle of an entrained fluid bed which offers improvements in combustion efficiency, sulfur oxide suppression, nitrogen oxide control and turn-down. Whereas bubbling bed combustors operate with superficial velocities in the range of 4–12 ft/second and have a clearly defined upper surface, entrained bed combustors operate at superficial velocities of 15 to 45 ft/second and have no clearly defined upper surface but rather a gradation of particulate density from the bottom to the top of the combustor. The particulate is entrained with the gas flow in the reactor and separated from it by a recycle cyclone downstream of the reactor whereupon the particulate is reintroduced into the base of the reactor. Particle size ranges from 30 to 250 microns and the particle density of 10 to 40 kg/cu m in the upper portion of the reactor. Heat is not recovered from the particulate or gases in the reactor or recycle loop. Tubes in the reactor would be subject to high erosion and would not be effective in transferring heat because of the low particle density compared to that of a bubbling bed (500 kg/cu m). Heat is recovered by draining a portion of the bed from the base of the reactor and cooling it in a separate fluid bed heat exchanger optimized for that process. High combustion efficiency is obtained by completely burning small diameter fuel particles in the highly turbulent reactor and the hot recycle loop. Good sorbent usage is also obtained by using fine particulate and maintaining it at an effective temperature throughout the reactor and recycle loop. Limited nitrogen oxide control is obtained by progressively introducing combustion air along the length of the reactor. The disadvantage of the system is the need for the separate fluidized bed heat exchanger and large recycle cyclones.

The discussion immediately above related to a specific entrained fluid bed combustor which is described in more detail in Reh U.S. Pat. No. 4,111,158. In general, certain typical aspects of this type of combustor should be emphasized here. First, it should be noted that there is no clearly defined bed in the combustion zone of this type of combustor. Combustion occurs throughout the vessel including its freeboard and recycle cyclone. Heat is typically extracted throughout the freeboard to maintain constant temperature there. To this end, the outer walls defining the freeboard are cool (as a result of the presence of adjacent heat exchangers) and additional secondary combustion air is typically added to achieve complete fuel burnout. Thus, this approach lends itself to efficient suppression of sulfur oxide and nitrogen oxide.

Ammonia infection to suppress nitrogen oxides without a catalyst is taught by Lyon in U.S. Pat. No. 3,900,554. Lyon describes the basic gas phase reaction whereby ammonia selectively reduces nitrogen oxide in the presence of oxygen at 1742° F. to 1832° F. and predicts a suppression of 20% at an ammonia/nitrogen oxide molar ratio of 2. Lyon does not teach the benefits of good mixing, as in the recycle cyclone, which produced nitrogen oxide reductions of 95% at the same molar ratio of 2.

DISCLOSURE OF THE INVENTION

An object of the present invention is to provide a fluid bed fuel combustion technique which achieves (1) high combustion efficiency, (2) efficient sorbent utilization, (3) low sulfur oxide and nitrogen oxide concentrations in the flue gases, and (4) low erosion and low bed material makeup in the fluid bed.

A more specific object of the present invention is to provide a fluid bed fuel combustion technique (1) in which fuel combustion takes place substantially only within the fluid bed, (2) in which heat energy is recovered substantially only in the fluid bed where combustion takes place, and (3) in which a recycle path of particles having a substantially constant temperature throughout its path is established, whereby to achieve the objectives recited immediately above.

Still another specific object of the present invention is to provide the particularly designed fluidized bed arrangement which insures that substantially all combustion takes place within the bed.

As will be described above in more detail hereinafter, the fluidized bed fuel combustion technique disclosed herein burns solid particulate or liquid fuel and recovers useful energy therefrom. This technique maintains a generally horizontal bed of inert (non-fuel) particles, for example limestone or dolomite sorbent, ash and some partially burned fuel on a distribution plate within an internal combustion chamber of a fluid bed combustor which also defines a freeboard immediately above the bed of particles. A continuous stream of fluidizing gas is directed upward within the combustion chamber from below the distribution plate so that the stream passes through the plate and bed of particles for fluidizing the latter. The velocity of the stream of gas is such that the stream carries fine particles of a certain size and smaller upward with it into the freeboard from the fluidizing bed. Substantially all of these fine particles carried upward by the stream of fluidizing gas are captured within a recycle cyclone which forms part of the combustor and which is positioned above the freeboard. The recycle cyclone returns most of the captured particles to the fluidizing bed while exhausting the gas to waste heat recovering equipment (not shown), whereby the captured and returned fine particles define a recycling path of movement from the bed, through the freeboard and cyclone and back into the bed.

In accordance with one feature of the present invention, the fluid bed combustor disclosed herein is operated in a way which insures that substantially all combustion takes place only within the fluid bed and not in either the freeboard or the cyclone. In accordance with a second feature of the present invention, the fluid bed combustor is operated in a way that insures that the recycling path of fine particles from the fluid bed, through the freeboard and cyclone, and back into the bed is maintained at a substantially constant temperature, preferably a temperature substantially equal to the temperature within the fluid bed. In accordance with a third feature of the present invention, heat energy from combustion taking place in the fluidizing bed is recovered only from within the bed and not in the recycling path.

As indicated above, one feature of the present invention resides in operating the fluid bed combustor such that substantially all combustion takes place within the fluidizing bed. As will be described in more detail hereinafter, this is accomplished by maintaining the bed of particles at a predetermined depth, feeding the fine and light fractions of the fuel at the bottom of the bed only and feeding larger and heavy fuel particles at the top of the bed. In this way, before fuel fines can be elutriated into the fluidizing gas stream, they must pass entirely through the bed from the bottom thereof. The depth of the bed is selected so that these particles completely combust or substantially completely combust by the time they reach the top of the bed from where they can be elutriated.

In accordance with the present invention, the fluidized bed combustor disclosed herein is designed for substantially complete energy release in the fluid bed, as indicated above. The fluid bed depth, operating velocities and excess air, together with the way fine fuel is directed into the bed at its bottom and the larger particle fuel at the top, provide the necessary residence time, fuel-air mixture and temperature conditions to complete the fuel combustion reaction within the fluid bed. Heat transfer surfaces within the combustor vessel are only located in the fluid bed. There are no heat transfer extraction surfaces above the bed in the freeboard or immediately preceding (or within) the recycle cyclone. By completing the combustion reactions within the fluid bed, the heat transfer surfaces required for proper energy balance within the combustion system are solely located in the fluid bed. The freeboard volume above the bed and the cyclones can thus be operated at constant temperatures and non-combustion conditions. No secondary air injection is necessary to complete combustion as required in conventional bubbling bed. Since there is no reaction above the bed and no energy extraction there, by insulating the entire combustor along its recycle path, that is, around the freeboard volume and throughout the recycle cyclone, an isothermal mass is established throughout the recycle path and operates at essentially the fluid bed temperature. The selected operating temperature range (1550° F.–1700° F.) together with the airflow velocities through this zone provide the temperature, residence time and mixing required to drive to completion reactions for emission control.

Unlike the conventional bubbling bed or the circulating bed combustors where energy release occurs throughout the freeboard section of the combustion system as a result of continuing fuel combustion, the present invention completes the combustion within the fluid bed proper at a temperature essentially equal to the freeboard temperature. Completion of all combustion reaction in the bed surrounded by a dense concentration of particles provides for optimum capture of the sulfur oxide gas by the sorbent and avoids generation of sulfur oxide or nitrogen oxide in the freeboard and/or recycle cyclone areas.

In addition to the foregoing, as will be discussed in more detail hereinafter, the particles making up the fluidized bed are quite small as compared to conventional bubbling beds. At the same time, the superficial velocity of the fluidizing gas passing through the bed is relatively low. The low operating velocity of the fluidizing gas together with the recycle cyclone which is of a high performance type minimizes elutriation of material from the fluid bed system and thus essentially eliminates the necessity for makeup bed material.

A further object of the present invention is to achieve the benefits of high combustion efficiency and good sorbent utilization without using a separate fluidized bed heat exchanger with a large recycle cyclone.

The present invention utilizes a bubbling fluid bed combustor with tubes in the bed for heat transfer but with bed particles whose average diameter is in the range of 250 to 400 microns wherein 20% to 40% of the particles, respectively, are less than 200 microns in diameter. The superficial velocity of the bed is 3 to 7 ft/second, well below the 15 to 45 ft/second of the entrained bed. The result of the relatively low superficial velocity combined with a bed of small diameter particulate is to produce a bubbling bed but with a high rate of elutriation of the fines component of the bed.

Compared to a conventional bubbling bed combustor, it uses a much smaller average particle size (250 microns versus 350 microns) and has considerably higher bed transport. The recycle rate of a conventional bubbling fluid bed boiler is approximately equal to the combined solids feed rates whereas the recycle rate of the present invention is 20 times that value, equivalent to changing the bed every 40 minutes. Unlike the bubbling bed combustors but similar to the entrained bed combustors, the present invention has no heat transfer surfaces between the bed and the recycle cyclone to cool the gas and particulate, hence contains an isothermal recycle loop operating at the ideal temperature for combustion or sulfur sorption. Unlike either the bubbling bed combustor or the entrained combustor the subject invention uses ammonia injection at the inlet of the recycle cyclone for control of nitrogen oxide emissions. Other benefits are a 100% to 300% increase in heat transfer coefficient on the tubes in the bed because of the small particle size in the bed and a reduction in tube erosion (compared to conventional bubbling beds) because of the low superficial velocities. (Tube erosion increases exponentially with superficial velocity). Another attractive feature is a 10:1 range of fluidization velocities which allows for a full fluidized start up at low system throughputs.

DETAILED DESCRIPTION

Figure 1:
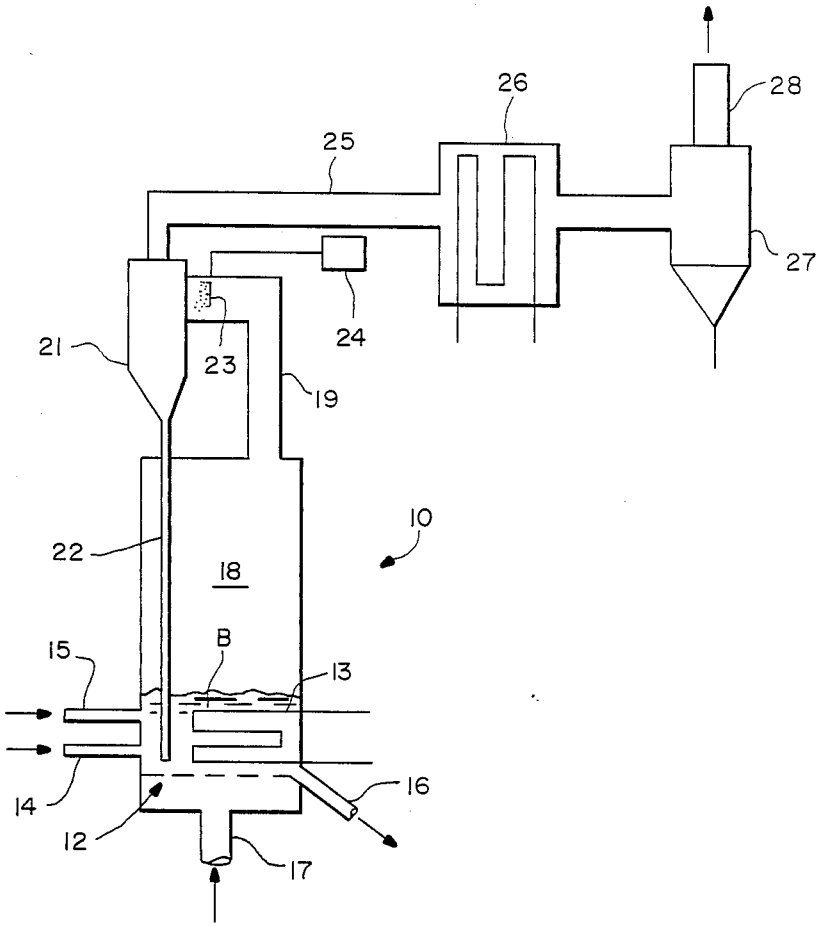
FIG. 1 is a schematic elevational sectional view of a complete system in which the present invention is embodied and utilized.

The present invention is embodied and employed in a system comprised of a fluid bed combustor 10 having a combustion chamber 11 for containing a fluid particle bed B supported on a distribution plate 12. The combustor 10 includes cooling tubes 13 in the fluid bed B as well as a fuel feed 14, sorbent feed 15 and bed drain 16. Fluidizing air is introduced in the bottom of the combustor 10 at 17. The hot gas and elutriated particulate leaving the surface of the bed B pass through the freeboard 18 and are directed via a conduit 19 to a recycle cyclone 21 mounted above the bed to provide a straight dip leg 22 with adequate head in the dip leg to provide a free flowing return of fine particulate to the bed. The cut point of the recycle cyclone 21 is approximately 14 microns.

Ammonia is injected into the hot gas stream in the conduit 19 immediately upstream of the recycle cyclone by an ammonia injector 23 to suppress nitrogen oxides when burning fuel with the fuel-bound nitrogen. Ammonia is supplied from a supply tank 24.

Hot gas leaving the recycle cyclone 21 via a conduit 25 passes through a convection heater 26 where the remaining heat is removed from the hot gas. Downstream of the convection heater 26 the gas passes through a filter system 27, such as a baghouse filter, to remove dust before being exhausted to the atmosphere through the stack 28.

According to this invention we provide fluidized bed combustion system method and apparatus which comprises a bubbling fluid bed combustor with a superficial velocity in the range of 0.5 ft/second to 7 ft/second but with bed material in the size range of 45 microns to 2000 microns in diameter whereby 40% to 20% of the bed material, respectively, is less than 200 microns in diameter and the average particle size is in the 250–400 micron range. The large fraction is associated with dolomite or limestone feedstock size when $SO_2$ sorbent is used. The bubbling bed contains tubes to transfer heat from the hot fluid bed; the heat transfer coefficient on the outside of those tubes is in the range of 90 to 200 BTU/FT2-HR-F because of the fine particulate in the bed. Substantially all of the fine solid fuel ($\frac{1}{4}''-$) and all of the liquid fuel are fed directly into the bottom of the bed with the fuel guns to be described hereinafter in conjunction with FIG. 2. The sulfur sorbent such as limestone or dolomite and the oversized fuel ($\frac{1}{4}''+$) are fed directly to the top of the bed through above-the-bed feeders, also to be described in conjunction with FIG. 2. The fluidized bed depth is selected to provide the residence time of the fuel within the bed to essentially complete all the heat release reactions in the bed. In other words, the particulate makeup and depth of the bed is specifically designed to insure that substantially all combustions take place there.

The fluid bed combustor has a hot freeboard that is refractory lined and that contains no heat transfer surfaces or means for accommodating secondary air flow within the freeboard. A large number of fines elutriated from the fluid together with the fluid bed of gases flow through the hot freeboard. The residence time of this particulate/gas flow mixture through the isothermal freeboard without heat extraction is usually seconds. This feature together with 20% to 30% excess air conditions provides for the reduction of gaseous fuel species such as CO and unburned hydrocarbons to very low levels. Most of the particulate elutriated from the bed into the freeboard fall back into the bed but a significant amount is transported by the gas flow into the recycle cyclone where it is separated from the gas and returned to the bed, all at substantially the same temperature as exists in the fluid bed. Particulates entering the cyclone contain some minor amounts of char which are recycled to the fluid bed for further oxidation. This process continues until the char particulates are small enough to penetrate the high performance cyclone. This returning of the char to the bed provides for additional time to combust char and thus provides for the high combustion efficiency of the invention. Particle loading of the gas entering the cyclone is approximately 0.5 kg/cu m. The extended residence time in the freeboard and the excellent mixing between the recycling solids and the gas stream is believed to be the enhancement for highly efficient nitrogen oxide suppression at temperatures down to 1400° F. Similarly, the extended residence time and the good mixing between the fine sorbent particles and the sulfur oxides in the combustion gas in the hot freeboard and the recycle cyclone promote additional sulfur oxide capture. The fine particulate spend approximately 1 second in the bed and 3 seconds in the freeboard and recycle cyclone. The recycle cyclone is designed with a cut point of approximately 13 microns and with a highly efficient dip leg to return the separated material to the fluid bed, thus preventing their escape from the fluid bed combustor system. The flow rate of the captured particulate around the recycle loop is approximately twenty times the combined flow of fuel and sorbent into the fluid bed. Its hourly flow rate is twice the weight of the fluid bed itself.

If the fuel contains fuel-bound nitrogen and nitrogen oxide suppression is required, ammonia is sprayed into the hot combustion gas stream at the inlet duct to the recycle cyclone. Although, ammonia selectively and most efficiently reduces nitrogen oxides without a catalyst in the range of 1743° F. to 1832° F., efficient reduction is normally achieved in the present invention by operating the combustion system so that the flue gas temperature of the cyclone inlet is in the 1450° F. to 1750° F. range. Injection of ammonia in ammonia/nitrogen oxide molar ratios of 1.5 to 2 provides nitrogen oxide suppression of 80% to 95% because isothermal, non-combustion gas conditions and because of the excellent mixing occurring in the recycle cyclone. Under certain conditions nitrogen oxides are suppressed without the use of ammonia injection.

The hot combustion gas and dust escaping the recycle cyclone pass through a convective heat exchanger where the gases are cooled to their exit temperature. Finally, a filter system removes the dust before discharging the combustion gas to the atmosphere.

The present invention thus provides the capability to burn cleanly a wide variety of solid and liquid fuels, some of which may be very difficult to burn (such as petroleum coke with 90% fixed carbon, i.e., low volatiles) or fuels which may contain sulfur or nitrogen, or the combination of sulfur and nitrogen, all of which cause air pollution. The present invention burns these fuels by using bubbling bed with a fine particulate composition and recycling a large portion of those fines through a hot recycle loop. Heat extraction from the fluid bed combustor/recycle cyclone system occurs only in the fluid bed. The fluid bed because of its fine particulates is very active and produces high mixing quality. This together with the high residence time of the fuel within the bed eventually releases all the energy in the bed. This feature together with the hot isothermal non-heat extraction freeboard and recycle cyclones provides for the high combustion efficiency and reduction of hydrocarbon emissions and CO emissions to very low levels. Combustion efficiency of 99.4% is obtained with petroleum coke with 90% fixed carbon, and 98% suppression of sulfur oxides is obtained with a calcium sulfur molar ratio of 1.8. A 95% suppression of nitrogen oxides is obtained with an ammonia/nitrogen oxide molar ratio of 2. All this occurs within the framework of the fluid bed recycle system and occurs simultaneous.

A further benefit of the present invention is a large fluidization range of up to 15:1. Because the bubbling fluid bed is composed of fine particulate, its minimum fluidization velocity is as low as 0.5 ft/second.

EXAMPLE—PETROLEUM COKE

Petroleum coke was burned with air in a fluidized bed combustor whose configuration is described in FIG. 1. The fluid bed combustor was three feet in diameter and twelve feet tall with the recycle cyclone mounted above it. The combustor was refractory lined. The bubbling bed was operated 3½ to 4 feet deep and contained air tubes to transfer heat out of the bed.

The petroleum coke used in the test had the following composition and heating value:

| | |
|---|---|
| Fixed Carbon | 89.7% by weight |
| Nitrogen | 1.9% |
| Sulfur | 2.1% |
| Volatile Matter | 8.4% |
| Ash | 0.3% |
| Moisture | 1.6% |
| HHV | 14,270 BTU/LB |

This fuel is difficult to burn because of the high fixed carbon with few volatiles. It also contains the elements of nitrogen and sulfur which produce nitrogen oxides and sulfur oxides as air pollutants. The fuel was introduced to the fluid bed through a fuel feed, the majority of the fuel being between 50 and 400 microns in diameter. Dolomite, a sulfur sorbent, was introduced into the bed through the sorbent feed. Its composition was:

| | |
|---|---|
| Calcium Carbonate | 56.6% by weight |
| Magnesium Carbonate | 45.5% |
| Inerts | 0.9% |

Its size was between 4700 microns and 1200 microns. This particular dolomite decrepitated in the bed into fine particles.

The fluid bed was initially composed of crushed dolomite with an average size of 800 microns.

After testing for approximately 500 hours the bed was comprised of ash, spent sorbent and partially spent sorbent; average particle size had stabilized at approximately 300 microns. The fluid bed operated at an average superficial velocity of 4 ft/second. It was necessary to drain bed material periodically to maintain a constant level.

The recycle cyclone was designed to hold the majority of particles greater than 8 microns within the fluid bed combustor and was designed with a free flowing dip leg to provide little resistance in the particulate return path. As a result, high recycle flow rates of fines were achieved whereby the recirculation per hour was approximately twice the weight of the bed and twenty times the combined solids feed rate. The fuel particulate and sorbent particulate, unable to leave the fluid bed with the gas stream until they had reached a very small size, were contained in the bed and comminuted by the action of the bed. Fuel particles, restrained from leaving the fluid bed combustor, burned to completion providing high combustion efficiency even with a difficult fuel containing approximately 90% fixed carbon. Combustion efficiency was further enhanced by the isothermal, no heat extractive nature of the recycle path. The fuel particle is heated to full combustion temperature in the bed and is not cooled either in the freeboard or the recycle cyclone. Operating at a bed temperature of 1600° F. with 20% to 30% excess air, combustion efficiencies of 99.4% were achieved. There was a slight temperature increase between the bed and the cyclone (50°-100° F.) due to burnout of the hydrocarbon and CO in the freeboard.

Comminution and retention of the sorbent particles provided a large surface area of the sorbent to absorb sulfur from gases in the fluid bed combustor. Ninety-eight percent sulfur oxide suppression was achieved at a calcium to sulfur molar ratio of 1.8. A further benefit of the fine particle size in the combustor was the increase in heat transfer coefficient on the surface of the tubes immersed in the bed. Heat transfer coefficients on the outside of the tubes ranging from 90 to 200 BTU/HR-FT2-F were observed compared to 40-60 BTU/HR-FT2-F for a conventional fluid bed boiler.

To suppress nitrogen oxides to meet local pollution control codes in Southern California, ammonia was injected upstream of the cyclone to mix with the combustion gas and selectively reduce nitrogen oxide to nitrogen and water according to the well-known reactions. At an NH3-to-NO molar ratio of 2, approximately 95% of the NO was suppressed.

EXAMPLE—UTAH COAL

Utah coal was burned in the same fluid bed combustor as previously described in the earlier example. The composition of the coal and its heating value were as follows:

| | |
|---|---|
| Fixed carbon | 43% |
| Nitrogen | 1.3% |
| Sulfur | 0.6% |
| Volatile Matter | 39.0% |
| Ash | 8.0% |
| Moisture | 10% |
| HHV | 11,500 BTU/LB |

The Utah coal had substantially less fixed carbon and substantially greater volatiles and hence was easier to burn than petroleum coke. The size of the coal was minus $1\frac{5}{8}$ inches. The sulfur sorbent was the same dolomite as used in the prior example. Its composition was as follows:

| | |
|---|---|
| Calcium carbonate | 56.6% by weight |
| Magnesium carbonate | 45.5% |
| Inerts | 0.9% |

Its size was between 1,200 microns and 4,700 microns but it decrepitated into fire particles in the bed.

Combustion efficiency with coal was 99.8% with 20% excess air at a bed temperature of 1600° F. For coal, the combustor could be operated as cool as 1400° F. with only 20% excess air and yet maintain good combustion characteristics. With petroleum coke, acceptable combustion characteristics could only be maintained at 1450° F. by increasing the excess air to 60%. For coal at 1600° F., afterburning above the bed was reduced to 10°-20° F. Suppression of sulfur oxides and nitrogen oxides was similar to that on petroleum coke.

Figure 2:
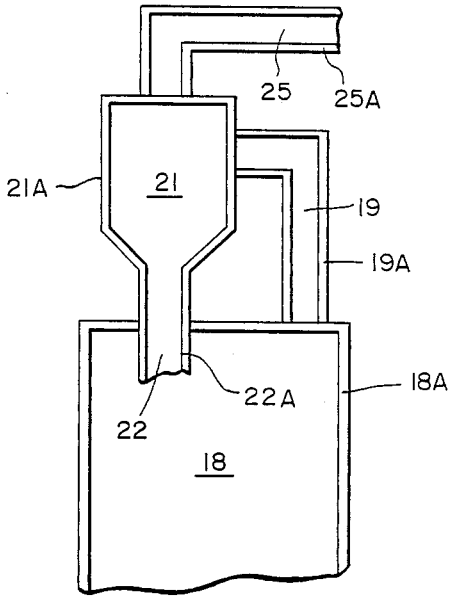
FIG. 2 illustrates and enlarged section of the system of FIG. 1, specifically depicting the way in which the system is thermally insulated.

As stated a number of times above, the fluid bed combustor of FIG. 1 establishes an isothermal recycle path, preferably at substantially the same temperature as the fluid bed. As also stated, this requires that the combustor be adequately insulated. FIG. 2 illustrate the insulation 18A about freeboard 18, insulation 19A about conduit 19, insulation layers 21A and 22A around cyclone 21 and leg 22, respectively, and insulation 25A around conduit 25. Other areas (not shown) may also be insulated, if necessary. The type of insulation and the thickness will depend upon the particular combustor. However, one with ordinary skill in the art, in view of the teachings herein can readily select the appropriate insulation and the amounts (and location) to meet the objectives disclosed herein. In an actual working embodiment, the insulation used is refractory insulation. In this same embodiment, layers 18A and 22A are about 11" thick, layer 21A is about 7-8" thick and layers 19A and 25A are about 8-9" thick.

Figure 3:
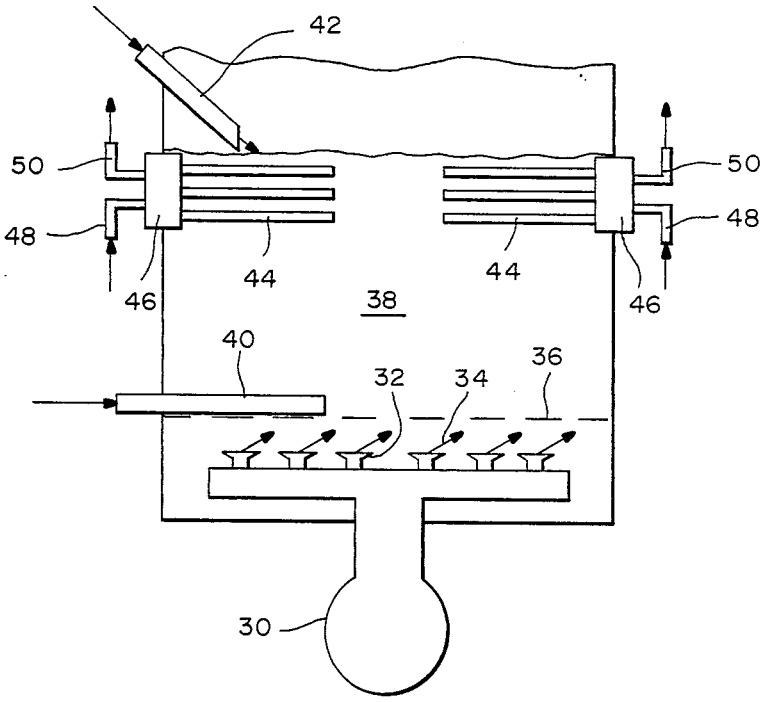
FIG. 3 is a schematic elevational view illustrating in detail a fluidizing bed which forms part of the overall system shown in FIG. 1 and the way in which the bed is maintained to insure that substantially all combustion takes place there.

As discussed in detail above, it is critical to the present invention that combustion takes place substantially entirely within its fluidizing bed. FIG. 3 illustrates a specific bed and feed design to accomplish this. As seen there, fluidizing air is delivered from its source (not shown) through a plenum 30 to a series of cooperating nozzles 32 which direct the air upward at an angle, as indicated by arrows 34. These nozzles are located below a generally horizontal distribution plate 36 and thus the air passes upward through the distribution plate and into and through the bed of particles generally indicated at 38. As shown in FIG. 3, the bed extends well above the distribution plate and is typically 3.5 to 5 feet deep.

In accordance with one feature of the present invention, there is a fuel inlet tube or tubes 40 entering the fluidized bed at its bottom end just above distribution plate 36. This inlet tube is connected to a source of air and fuel consisting of particulate fines. In an actual working embodiment, these particulate fines are at $\frac{1}{4}$"− (e.g. no larger than $\frac{1}{4}$"). At the same time, the overall bed arrangement includes an upper feed arrangement 42 for feeding large particles, for example $\frac{1}{4}$"+ (e.g. no smaller than $\frac{1}{4}$")in an actual embodiment, onto the top of the bed. In this way, the particles at the top of the bed including the fuel particles there will remain in place rather than being entrained by the rising fluidizing stream. On the other hand, the smaller entrainable particles at the bottom of the bed must first work their way up before they can be elutriated. The depth of the bed and size distribution of the particles are designed so that the particulate fuel within the bed substantially fully combusts before it reaches the top of the bed where it can be elutriated.

In accordance with another feature of the fluidized bed illustrated in FIG. 3, energy is recovered in the bed only and not from the recycling path. To this end, heat transfer tubes containing for example water, are disposed within the bed. As illustrated, two such arrangements are shown at 44. Each arrangement includes a series of tube turns making a series of turns within the bed from a common plenum 46. An inlet 48 is provided into each plenum along with an outlet 50. Recovering fluid, for example, water, enters the inlet and passes through the tube turns and eventually passes out the outlet where the heat is recovered.

What is claimed is:

1. A method of burning solid particulate fuel and recovering useful energy therefrom, comprising the steps of:

(a) maintaining a generally horizontal bed of inert particles, ash and some partially burned solid fuel particles on a distribution plate within an internal combustion chamber of a fluid bed combustor which also defines a freeboard immediately above the bed of particles;

(b) directing a continuous stream of fluidizing gas upward within said combustion chamber from below said distribution plate so that the stream passes through the plate and said bed of particles for fluidizing the latter, the velocity of said stream of gas being such that the stream carries fine particles of a certain size and smaller upward with it into the freeboard from the fluidizing bed;

(c) capturing substantially all of said fine particles carried upward by said stream of fluidizing gas within a particle recycle separator which forms part of the combustor and which is positioned above said freeboard, and returning most of the captured particles to the fluidizing bed while exhausting the gas from said separator, whereby the captured and returned fine particles define a recycling path of movement from the bed, through the freeboard and cyclone and back into the bed;

(d) recovering heat energy from combustion taking place in said fluidizing bed but not from said recycling path of fine particles; and (e) operating the fluid bed combustor including its fluidizing bed and separator such that substantially all combustion of said fuel particles takes place only within said bed and not in either the freeboard or the separator and such that said recycling path of fine particles is maintained at a substantially constant temperature.

2. A method according to claim 1 wherein said fluid bed combustor is refractory lined, whereby said recycling path of fine particles can be maintained at said substantially constant temperature even though substantially no combustion takes place in either said freeboard or separator.

3. A method according to claim 1 wherein said fluid bed combustor is operated such that afterburning of fuel particles above said fluidizing bed amounts to no more than about 100° F.

4. A method according to claim 1 wherein said fluid be combustor is operated such that afterburning of fuel particles above said fluidizing bed amounts to no more than about 20° F.

5. A method according to claim 1 wherein said generally horizontal bed of inert particles, ash and partially burned solid fuel maintained on said distribution plate has an average particle size in the range of 100 microns to 800 microns with 20% to 40% less than 200 microns and wherein said continuous stream of fluidizing gas is directed upward within said combustion chamber and below said distribution plate at a superficial velocity in the range of 0.5 to 7 feet per second.

6. A method according to claim 1 including the step of feeding a sulphur oxide sorbent into said fluidizing bed along with the other particles therein and maintaining the fluidizing bed of inert particles, ash, partially burned fuel particles, partially spent sulphur sorbent and spent sulphur sorbent with an average particle size in the range of 100 to 800 microns.

7. A method according to claim 1 wherein said fluid bed combustor is operated such that the temperature within said fluidizing bed and the temperature along said recycle path is between about 1400° F. and 1500° F. whereby to encourage minimum nitrogen oxide formation during the combustion of said fuel and to encourage char production with the attendant suppression of nitrogen oxide by hot char in said fluidizing bed and along said recycle path.

8. A method according to claim 1 wherein said fluidizing bed is operated such that particulate fuel particles which is within the bed and which is sufficiently fine to be carried by said stream of fluidizing gas is located sufficiently deep within the bed to substantially completely combust before reaching the top of the bed where it can be carried off by said gas stream.

9. A method according to claim 1 wherein said recycle separator is a recycle cyclone.

10. A method according to claim 1 wherein said fluid bed combustor is operated such that substantially no cooling of particles within either said freeboard or said recycle separator takes place.

11. A method according to claim 10 wherein no heat transfer surfaces are provided within said combustion chamber between said fluidizing bed and said recycle separator.

12. A method according to claim 1 including the steps of feeding fine particulate fuel into said bed, said fine fuel being fed only into the bottom of said bed, and feeding large, non-fine particulate fuel onto the top of said bed only.

13. A method according to claim 12 wherein said fine particulate fuel is $\frac{1}{4}''-$ and wherein large particulate fuel is $\frac{1}{4}''+$.

14. A method according to claim 1 wherein said fluid bed combustor is operated such that the temperature within the fluidizing bed and the temperature along said recycling path are substantially equal.

15. A method according to claim 6 wherein the temperature of said fluidizing bed and said recycling path is about 1400° F.

16. A method according to claim 14 wherein the temperature of said fluidizing bed and said recycling path is about 1600° F.

17. A method according to claim 1 wherein said fluid bed combustor is operated such that the temperature within said fluidizing bed is maintained between about 1450° F. and 1650° F. and afterburning of fuel particles above said bed amounts to no more than about 150° F., whereby to promote the efficient suppression of nitrogen oxide from fuel containing fuel bound nitrogen in the presence of ammonia, without the need for a catalyst.

18. A method according to claim 17 including the step of spraying ammonia into said recycle path of particle-laden gas immediately upstream of the inlet to the recycle separator, without a catalyst.

19. A method according to claim 17 wherein said fluid bed combustor is operated such that the temperature within said fluidizing bed is about 1450° F., whereby to promote the efficient suppression of nitrogen oxide from fuel having a high percentage of fixed carbon.

20. A fluid bed combustion apparatus for burning solid particulate fuel or liquid fuel and recovering useful energy therefrom, comprising:

(a) a fluid bed combustor including means for maintaining a generally horizontal bed of inert particles, ash and some partially burned solid fuel particles on a distribution plate within an internal combustion chamber defined by said fluid bed combustor, said combustor also defining a freeboard immediately above the bed of particles;

(b) means for directing a continuous stream of fluidizing gas upward within said combustion chamber from below said distribution plate so that the stream passes through the plate and said bed of particles for fluidizing the latter, the velocity of said stream of gas being such that the stream carries fine particles of a certain size and smaller upward with it into the freeboard from the fluidizing bed;

(c) means including a particle recycle separator for capturing substantially all of said fine particles carried upward by said stream of fluidizing gas within said recycle separator which is positioned above said freeboard, and for returning most of the captured particles to the fluidizing bed while exhausting the gas from said separator, whereby the captured and returned fine particles define a recycling path of movement from the bed, through the freeboard and separator and back into the bed;

(d) means for recovering heat energy from combustion taking place in said fluidizing bed but not from said recycling path of fine particles; and (e) said fluid bed combustor including its fluidizing bed and separator being configured such that substantially all combustion of said fuel particles takes place only within said bed and not in either the freeboard or the separator and such that said recycling path of fine particles is maintained at a substantially constant temperature.

21. An apparatus according to claim 20 wherein said fluid bed combustor is such that the temperature within the fluidizing bed and the temperature along said recycling path are substantially equal.

22. An apparatus according to claim 20 wherein said fluid bed combustor is configured such that afterburning of fuel particles above said fluidizing bed amounts to no more than about 100° F.

23. An apparatus according to claim 20 wherein said fluid bed combustor is configured such that afterburning of fuel particles above said fluidizing bed amounts to no more than about 20° F.

24. An apparatus according to claim 20 including means for spraying ammonia into said recycle path of particle-laden gas immediately upstream of the inlet to the recycle separator without a catalyst.

25. An apparatus according to claim 20 wherein said generally horizontal bed of inert particles, ash and partially burned solid fuel maintained on said distribution plate has an average particle size in the range of 100 microns to 800 microns width 20% to 40% less than 200 microns and wherein said continuous stream of fluidizing gas is directed upward within said combustion chamber and below said distribution plate at a superficial velocity in the range of 0.5 to 7 feet per second.

26. An apparatus according to claim 20 including means for feeding a sulphur oxide sorbent into said fluidizing bed along with the other particles therein and maintaining the fluidizing bed of inert particles, ash, partially burned fuel particles, partially spent sulphur sorbent and spent sulphur sorbent with an average particle size in the range of 100 to 800 microns.

27. An apparatus according to claim 20 wherein said fluidizing bed is configured such that particulate fuel particles which are within the bed and which are sufficiently fine to be carried by said stream of fluidizing gas are located sufficiently deep within the bed to substantially completely combust before reaching the top of the bed where it can be carried off by said gas stream.

28. An apparatus according to claim 20 wherein said recycle separator is a recycle cyclone.

29. An apparatus according to claim 20 wherein said fluid bed combustor is configured such that substantially no cooling of particles within either said freeboard or said recycle separator takes place.

30. An apparatus according to claim 29 wherein no heat transfer surfaces are provided within said combustion chamber between said fluidizing bed and said recycle separator.

31. An apparatus according to claim 20 including means for said fine fuel being fed only into the bottom of said bed, and including means for feeding large, non-fine particulate fuel onto the top of said bed only.

32. An apparatus according to claim 31 wherein said fine particulate fuel is $\frac{1}{4}''-$ and wherein large particulate fuel is $\frac{1}{4}''+$.

33. An apparatus according to claim 20 wherein said fluid bed combustor is refractory lined, whereby said recycling path of fine particles can be maintained at said substantially constant temperature even though substantially no combustion takes place in either said freeboard or separator.

34. An apparatus according to claim 33 wherein the temperature of said fluidizing bed and said recycling path is about 1400° F.

35. An apparatus according to claim 33 wherein the temperature of said fluidizing bed and said recycling path is about 1600° F.

36. A fluid bed combustion apparatus, comprising:

(a) housing means defining an internal combustion chamber;

(b) means including a distribution plate for maintaining a generally horizontal bed of inert particles, ash and partially burned solid fuel particles on said distribution plate and within said internal combustion chamber directly below a freeboard within the chamber;

(c) means for directing a continuous stream of fluidizing gas upward within said combustion chamber from below said distribution plate so that the stream passes through the plate and said bed of particles for fluidizing the latter, the velocity of said stream of gas being such that the stream carries fine particles of a certain size and smaller upward with it into the freeboard from the fluidizing bed;

(d) means including a particle recycle separator located within said combustion chamber above said freeboard for capturing substantially all of said fine particles carried upward by said stream of fluidizing gas and for returning most of the captured particles to said fluidizing bed while exhausting the gas from said separator, whereby the captured and returned particles define a recycling path of movement from the bed, through the freeboard and separator and back into the bed;

(e) means for recovering heat energy only from within said fluidizing bed and not from said recycling path of fine particles; and (f) said fluidizing bed, separator and freeboard therebetween being configured such that substantially all combustion of said fuel particles takes place only within said bed and not within either the freeboard or the separator and such that said recycling path of fine particles is maintained at a substantially constant temperature.

37. An apparatus according to claim 36 including first means for feeding fine particulate fuel into the bottom of said bed and second means for feeding large particulate fuel onto the top of said bed.

38. An apparatus according to claim 36 wherein said fluidizing bed is operated such that particulate fuel which is within the bed and which is sufficiently fine to be carried by said stream of fluidizing gas is located sufficiently deep within the bed to substantially completely combust before reaching the top of the bed where it can be carried off by said gas stream.

39. An apparatus according to claim 36 wherein said recycle separator is a recycle cyclone.

40. An apparatus according to claim 36 wherein said first and second particulate fuel feed means are the only feed means forming part of said apparatus.

41. An apparatus according to claim 40 wherein said fine particulate fuel is $\frac{1}{4}''-$ and where said large particulate fuel is $\frac{1}{4}''+$.

* * * * *

UNITED STATES PATENT AND TRADEMARK OFFICE

CERTIFICATE OF CORRECTION

PATENT NO. : 4,843,981

DATED : July 4, 1989

INVENTOR(S) : Goldbach et al.

It is certified that error appears in the above-identified patent and that said Letters Patent is hereby corrected as shown below:

On the title page:

Under "Related U.S. Application Data", after "Sep. 24, 198", delete [6] and insert --4--

Column 6, Line 6, after "illustrates", delete [and] and insert --an--.

Column 12, Line 32, after "which", delete [is] and insert --are--.

Column 12, Line 32, after "and which" delete [is] and insert --are--.

Column 12, Line 33, after "gas", delete [is] and insert --are--.

Column 12, Line 36, after "where" delete [it] and insert --they--.

Signed and Sealed this

Fifth Day of June, 1990

*Attest:*

HARRY F. MANBECK, JR.

*Attesting Officer*

*Commissioner of Patents and Trademarks*